United States Patent [19]

Nishizawa et al.

[11] Patent Number: 4,491,061

[45] Date of Patent: Jan. 1, 1985

[54] AIR CONDITIONING SYSTEM

[75] Inventors: Toshio Nishizawa, Kawasaki; Keiji Kamata, Yamato; Osamu Nonomura; Yutaka Fukushi, both of Sagamihara, all of Japan

[73] Assignee: Topre Corporation, Tokyo, Japan

[21] Appl. No.: 536,502

[22] Filed: Sep. 28, 1983

[30] Foreign Application Priority Data

Sep. 6, 1983 [JP] Japan ..... 58-163689

[51] Int. Cl.[3] ..... F25B 29/00; F24F 13/00

[52] U.S. Cl. ..... 98/34.6; 165/16; 417/286

[58] Field of Search ..... 236/49; 98/33 R, 33 A; 165/16; 417/2, 286

[56] References Cited

U.S. PATENT DOCUMENTS 4,199,101 4/1980 Bramon et al. ..... 165/16 X 4,347,712 9/1982 Benton et al. ..... 165/16 X 4,407,185 10/1983 Haines et al. ..... 98/33 A

*Primary Examiner*—William E. Wayner

*Attorney, Agent, or Firm*—Oblon, Fisher, Spivak, McClelland & Maier

[57] ABSTRACT

In an air conditioning system, a damper unit disposed in the middle of a circulating duct is controlled so that a throttle valve of at least one of air quantity regulating devices for controlling incoming outside air quantity and exhaust air quantity is fully open, and that the quantity of air passing through the device whose throttle valve is fully open is equal to a set air quantity. The control system for the damper unit is so-called floating control system that is responsive to the control conditions. If none of the throttle valves of the devices is fully open, then there must be too great a pressure difference to pass the set quantity of air through all the devices. Accordingly, the excessive pressure applied to the devices can be lowered to a proper level by driving the damper unit in an opening direction, thereby reducing pressure loss between the discharging and charging blowers. If the throttle valve of at least one of the devices is fully open, and if the passage air quantity is smaller than the set air quantity, then the pressure applied to the devices must be too small to pass the set quantity of air. Accordingly, the insufficient pressure applied to the devices can be increased to the proper level by driving the damper unit in a closing direction, thereby increasing the resistance between the discharging and charging blowers.

7 Claims, 18 Drawing Figures t1
t2
t3
t4
t5

AIR CONDITIONING SYSTEM

BACKGROUND OF THE INVENTION

The present invention relates to an air conditioning system having air quantity regulating devices for air intake and exhaust, and more specifically to an air conditioning system having a charging blower and a discharging blower and adapted to perform air intake and exhaust through ducts connected to an air conditioner.

In a conventional air conditioning system, a damper for regulating the incoming outside air quantity is disposed in a duct which connects an outside air intake port and an air conditioner, and another damper for regulating the exhaust air quantity is disposed in a duct which connects a discharging blower and an exhaust port.

Hereupon, part of the air discharged from an air conditioning zone by the discharging blower is circulated into the air conditioning zone without being exhausted. To attain this, another duct is used to connect the air conditioner and the middle portion of the duct which connects the discharging blower and the discharging air quantity regulating damper. Since the pressure difference between the discharging blower and the air conditioner is very large, an additional air quantity regulating damper is provided in the duct for circulation.

In such air quantity regulating process, the quantity of required air is detected as the air flows through the opening of the damper, based on a damper characteristic (pressure difference-air quantity characteristic) which is obtained under predetermined conditions. In an ordinary air conditioning system, however, it is difficult to maintain a constant pressure difference between specified regions. In operations for outside air intake and exhaust, in particular, the conditions or circumstances surrounding the outside air intake port and exhaust port vary with the changes of the direction and speed of the wind outside the building in which the air conditioning system is installed. Also, the conditions may change according to the degree of contamination of an air filter attached to the air conditioner. In an air conditioning system of a variable air quantity type, moreover, charging and discharging air quantities change with fluctuations of load in the air conditioning zone. Thus, the changes in pressure applied to the outside air intake port and exhaust port are very great even if the charging and discharging blowers are controlled.

These circumstances indicate that proper air quantity control can be achieved only by detecting the pressure condition for every moment and controlling the opening of the air quantity regulating damper while weighting the detected pressure condition against the damper characteristic.

However, it costs too high to be practical to control the damper opening by detecting and calculating several variable factors every moment for the regulation of the incoming air outside air quantity and exhaust air quantity.

These prior art control methods cannot practically achieve accurate air quantity regulation, raising the following problems.

(1) If the incoming outside air quantity is larger than a set value, air conditioning load will increase.

(2) If the incoming outside air quantity is smaller than a set value, a draft entering the air conditioning zone through a door or window sill increase, so that the air conditioning load will increase.

(3) If the exhaust air quantity is smaller than a set value, a foul smell and poisonous gas in the air conditioning zone will increase to spoil environment.

(4) If the incoming outside air quantity is not equal to the exhaust air quantity, well-balanced air conditioning in the air conditioning zone can not be achieved.

These problems have been ignored as insignificant for air conditioning systems of a single- or dual-duct constant air quantity type. However, they are expressly significant for air conditioning systems of a single-duct variable air quantity type.

SUMMARY OF THE INVENTION

The present invention is contrived in consideration of the aforementioned circumstances, and is intended to provide an air conditioning system capable of stable air quantity control for outside air intake and exhaust, not influenced by variations in the direction and speed of the wind and the degree of contamination of a filter, nor by changes in charging and discharging air quantities caused by the control charging and discharging blowers in accordance with fluctuations of load in an air conditioning zone.

To attain the above object, an air conditioning system according to the invention is characterized in that a damper unit disposed in the middle of a circulating duct is controlled so that a throttle valve of at least one of devices for controlling incoming outside air quantity and exhaust air quantity is fully open, and that the quantity of air passing through the air quantity regulating device whose throttle valve is fully open is equal to a set air quantity.

The control system for the damper unit is not a fixed-quantity position control system, but a so-called floating control system that is responsive to the control conditions. If none of the throttle valves of the air quantity regulating devices is fully open, then there must be too great a pressure difference to pass the set quantity of air through all the air quantity regulating devices. Accordingly, the excessive pressure applied to the air quantity regulating devices can be lowered to a proper level by driving the damper unit in an opening direction, thereby reducing pressure loss between the discharging and charging blowers.

If the throttle valve of at least one of the air quantity regulating devices is fully open, and if the passage air quantity is smaller than the set air quantity, then the pressure applied to the air quantity regulating device must be too small to pass the set quantity of air. Accordingly, the insufficient pressure applied to the air quantity regulating devices can be increased to the proper level by driving the damper unit in a closing direction, thereby increasing the resistance between the discharging and charging blowers.

In other words, the damper unit in the circulating duct is controlled so that the throttle valve of at least one of the air quantity regulating devices is fully open, and that the passage air quantity is equal to the set air quantity.

The passage air quantity is an actual air quantity which is subject to the influence of the variations of the pressure loss on the filter and ducts, the direction and speed of the wind, the operating conditions of the blowers, etc. According to the present invention, the quantity of air passing through the air quantity regulating devices is used as one of control standards, so that the changes of those various conditions are detected every moment. Thus, the outside air intake and exhaust can automatically be achieved with high reliability without adjusting the balance of the air quantity regulating devices and the damper unit.

DETAILED DESCRIPTION OF THE PREFERRED EMBODIMENTS

One embodiment of an air conditioning system according to the present invention will now be described in detail with reference to the accompanying drawings of FIGS. 1 to 6.

Figure 1:
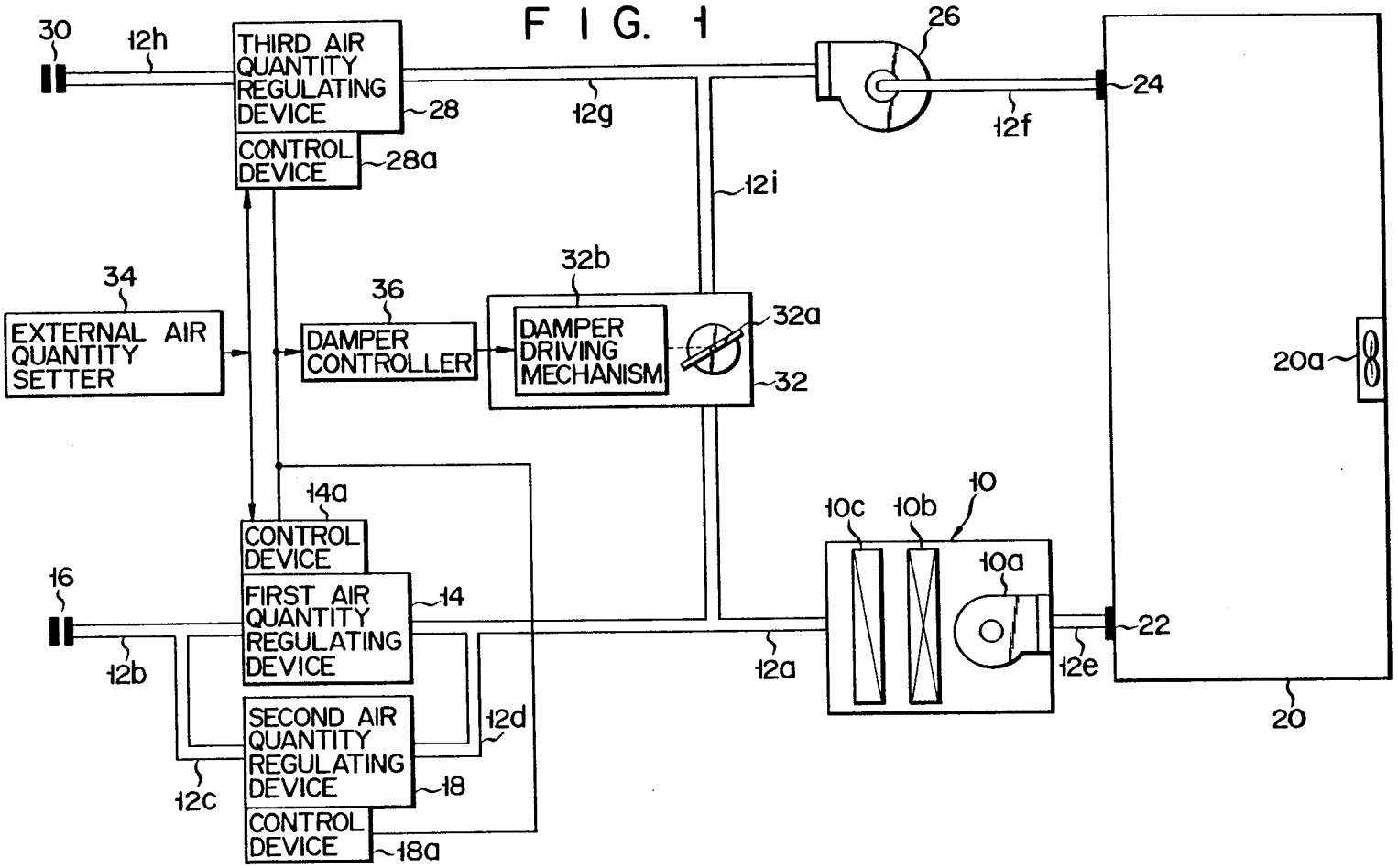
FIG. 1 is a view schematically showing an arrangement of one embodiment of an air conditioning system according to the present invention.

As shown in FIG. 1, the air conditioning system is provided with an air conditioner 10. The inlet of the air conditioner 10 is connected to the outlet of a first air quantity regulating device 14 by an intake duct 12*a*. The inlet of the first air quantity regulating device 14 is connected to an outside air intake port 16 by an outside air intake duct 12*b*. A second air quantity regulating device 18 is disposed in parallel with the first air quantity regulating device 14. The inlet of the second air quantity regulating device 18 communicates with the middle portion of the outside air intake duct 12*b* through a first branch duct 12*c*, and the outlet with the middle portion of the intake duct 12*a* through a second branch duct 12*d*. The outlet of the air conditioner 10 is connected to a blowoff port 22 of an air conditioning zone 20 by a charging duct 12*e*.

The air conditioning zone 20 has a suction port 24 which is connected to the inlet of a discharging blower 26 by a suction duct 12*f*. The outlet of the discharging blower 26 is connected to the inlet of a third air quantity regulating device 28 by a discharging duct 12*g*. The outlet of the third air quantity regulating device 28 is connected to an exhaust port 30 by an exhaust duct 12*h*. The middle portion of the discharging duct 12*g* communicates with that of the intake duct 12*a* through a circulating duct 12*i*, whereby part of discharging air is circulated. A damper unit 32 is disposed in the circulating duct 12*i*.

A charging blower 10*a*, a heat exchanger 10*b*, and a filter 10*c* are arranged in the air conditioner 10. The filter 10*c* serves to remove dust from the outside air and circulated air. The charging blower 10*a* is intended to supply air heated or cooled by the heat exchanger 10*b* to the air conditioning zone 20 through the charging duct 12*e* and the blowoff port 22. The charging blower 10*a* is driven by a drive motor (not shown), such as an induction motor.

The second air quantity regulating device 18 regulates the incoming outside air quantity so as to compensate the quantity of air exhausted from e.g., a washroom by the exhauster 20*a* in the air conditioning zone 20. Thus, the second air quantity regulating device 18 serves to match the quantity of the outside air introduced into the air conditioning zone 20 to the quantity of air exhausted therefrom.

The first and third air quantity regulating devices 14 and 28 control the incoming outside air quantity and exhaust air quantity, respectively, to maintain the room air condition. The quantity of air allowed to pass through the first and third air quantity regulating devices 14 and 28 is set by an external air quantity setter 34. A control system, such as a $CO_2$ density indicator, an entropy control device, or a computer with programmed control standards, may be used for the external air quantity setter 34.

Each of the air quantity regulating devices 14, 18 and 28 adjusts the quantity of air passing therethrough to a desired value, and delivers information representing the current control conditions to a damper controller 36. The damper controller 36 controls the damper unit 32 in accordance with a controlling process described in detail later so that the incoming outside air quantity and exhaust air quantity take proper values. The damper unit 32 comprises a damper 32*a* disposed inside the circulating duct 12*i* and movable between a first position where the internal space of the duct 12*i* is fully open and a second position where the internal space is entirely closed, and a damper driving mechanism 32*b* for driving the damper 32*a*. The damper driving mechanism 32*b* is adapted, under the control of the damper controller 36, to move the damper 32*a* to the second position when the control signal input from the damper controller 36 is maximum, and to move the damper 32*a* to the first position when the input is minimum.

The arrangement of the air quantity regulating devices 14, 18, 28 will be described. The air quantity regulating devices 14, 18, 28 are of the same arrangement. Therefore, only the first air quantity regulating device 14 will be described.

Figure 2:
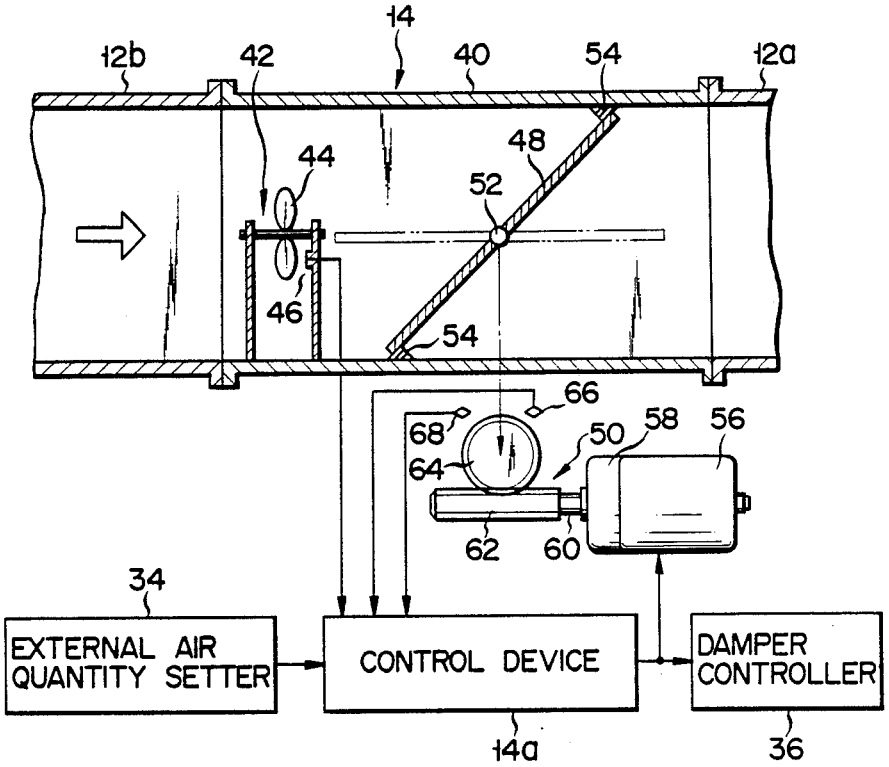
FIG. 2 is a sectional side view schematically showing a first air quantity regulating device.

Referring to FIG. 2, the first air quantity regulating device 14 has a unit duct 40. One of openings of the unit duct 40 communicates with the corresponding outside air intake duct 12*b* and the other opening thereof communicates with the corresponding intake duct 12*a*. In particular, air passes from one opening to the other opening in the unit duct 40, in the direction indicated by an arrow.

An air quantity detector 42 is disposed in the upstream of the unit duct 40. The air quantity detector 42 detects the flow rate at which air is passing through the unit duct 40 and supplies an air quantity signal corresponding to the flow rate to a corresponding control device 14*a*. The air quantity detector 42 comprises a propeller 44 which is rotatably arranged substantially at the center of the unit duct 40 and whose rotational frequency changes in accordance with the velocity of air stream which passes through the unit duct 40 and a rotational frequency detecting element 46 which detects the rotational frequency of the propeller 44. With this arrangement, the velocity of air passing through the unit duct 40 is detected, so that the air quantity is indirectly detected.

In the downstream of the unit duct 40, a throttle valve 48 is arranged which throttles an air channel within the unit duct 40. The throttl valve 48 is, for example, a plate valve which is driven by a drive mechanism 50. The throttle valve 48 includes a driven shaft 52 which extends horizontally at the center thereof. The driven shaft 52 is perpendicular to the direction in which air flows in the unit duct 40. The throttle valve 48 is pivotal about the driven shaft 52. The valve 48 completely interrupts air flow at a position inclined 60° to the horizontal direction (indicated by the solid line in FIG. 2) and allows complete air flow substantially at the horizontal position (indicated by the alternate long and two dashed line in FIG. 2). A pair of stoppers 54 which come in contact with both end faces of the throttle valve 48 are disposed at predetermined positions on the upper and lower inner surfaces of the unit duct 40.

The drive mechanism 50 which drives the throttle valve 48 has a reversible motor 56. The motor 56 includes a gear head 58 with a reduction mechanism. A drive shaft 60 which is rotated by the drive force of the motor 56 extends from the gear head 58. The drive shaft 60 extends in the direction in which air flows in the unit duct 40. At the top of the drive shaft 60, a worm gear 62 is disposed coaxially therewith. A worm wheel 64 meshes with the worm gear 62. The worm wheel 64 is fixed at one end of the driven shaft 52 and coaxial therewith. The motor 56 is controlled by the unit control device 32.

A pair of lead switches 66 and 68, which function as detectors and are spaced apart at a predetermined distance, are arranged at predetermined positions around the worm wheel 64. When the throttle valve 48 is fully opened and pressure loss of the air is thus minimized, the lead switch 66 detects the fully-open position of the valve 48. The lead switch 68 functions to detect the completely-closed position of the throttle valve 48. However, a limiter switch may be also used for this purpose. The fully-open position of the throttle valve 48, as described above, does not indicate the horizontal position, but here means the position where the opening area is maximum in the unit duct 40.

Figure 3:
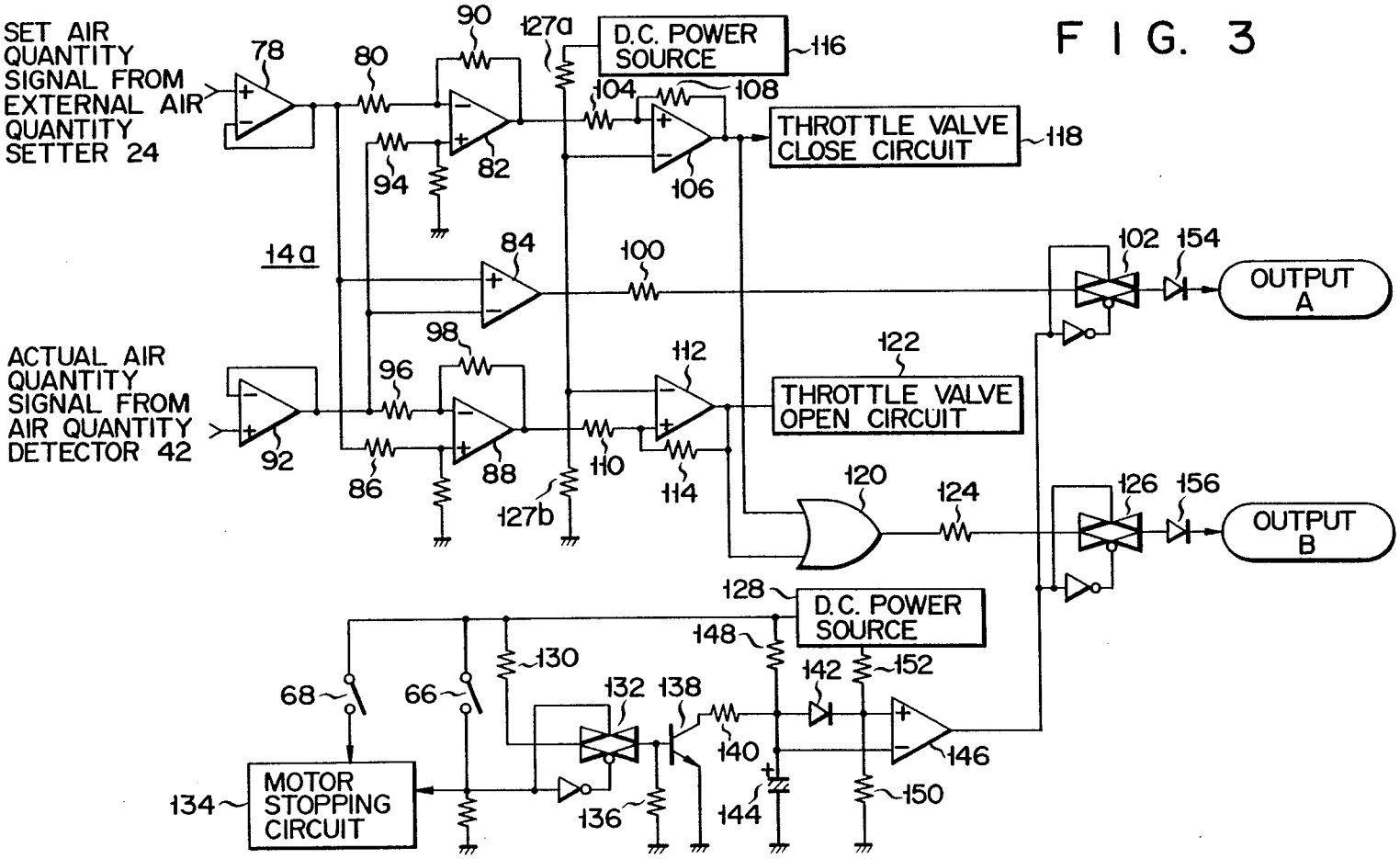
FIG. 3 is a circuit diagram showing a configuration of a control device connected to the first air quantity regulating device.

The control device **14*a* is shown in detail in FIG. 3. The unit control device 14*a* generates a signal of high level ("H") and a signal of low level ("L") in accordance with logical results, as shown in TABLE 1, from outputs A and B of the control device 14*a***.

Referring to TABLE 1, symbol P denotes the pieces of data which are represented by the air quantity signal and symbol T denotes the pieces of data which are represented by the set air quantity signal of the external air quantity setter 34.

TABLE 1

| Output | A | | | B | | |
|---|---|---|---|---|---|---|
| Dampers Condition | Not fully Open | Fully open | | Not fully Open | Fully open | |
| | | $T < P$ | $T > P$ | | $P \neq T$ | $P = T$ |
| Output level | "L" | "L" | "H" | "L" | "H" | "L" |

As shown in FIG. 3, the external air quantity setter 34 is connected to a non-inverting input terminal of a first operational amplifier 78 (to be referred to as first OP Amp. hereinafter). An inverting input terminal of the first OP Amp. 78 and an output terminal thereof are connected to each other. The output terminal of the first OP Amp. 78 is connected to an inverting input terminal of a second OP Amp. 82 through a resistor 80, a non-inverting input terminal of a third OP Amp. 84 and a non-inverting input terminal of a fourth OP Amp. 88 through a resistor 86. The inverting input terminal of the second OP Amp. 82 and the output terminal thereof are connected to each other through a resistor 90. The resistors 80 and 90 form a negative feedback circuit of the second OP Amp. 82.

On the other hand, the air quantity detector 42 is connected to a non-inverting input terminal of a fifth OP Amp. 92. An inverting input terminal of the fifth OP Amp. 92 and an output terminal thereof are connected to each other. The output terminal of the fifth OP Amp. 92 is connected to the non-inverting input terminal of the second OP Amp. 82 through a resistor 94, an inverting input terminal of the third OP Amp. 84 and the inverting input terminal of the fourth OP Amp. 88 through a resistor 96. The inverting input terminal of the fourth OP Amp. 88 and the output terminal thereof are connected to each other through a resistor 98. The resistors 96 and 98 form a negative feedback circuit of the fourth OP Amp. 88.

The output terminal of the third OP Amp. 84 is connected to an input terminal of a first bilateral switch 102 through a resistor 100. The third OP Amp. 84 functions as a comparator. When the non-inverting input terminal of the third OP Amp. 84 receives a signal whose level is higher than a signal which is input to the inverting input terminal thereof, the third OP Amp. 84 outputs a signal of high level. Otherwise, the third OP Amp. 84 outputs the signal of low level. In the other words, when the set air quantity signal T is higher than the actual air quantity signal P, the third OP Amp. 84 outputs the signal of high level. On the other hand, when the set air quantity signal T is smaller than the actual air quantity signal P, the third OP Amp. 84 outputs the signal of low level. The first bilateral switch 102 is turned on only when a signal of high level is input to a control input terminal of the bilateral switch 102. The first bilateral switch 102 outputs a signal of high level or a signal of low level in correspondence with the input signal of high or low level. When the signal of low level is input to the control input terminal of the first bilateral switch 102, the first bilaterial switch 102 is turned off, so that the signal of low level may be output even if the signal of low level or the signal of high level is input to the input terminal of the first bilateral switch 102 because a resistor 164 of FIG. 4 to be described later is grounded.

The output terminal of the second OP Amp. 82 is connected to a non-inverting input terminal of a sixth OP Amp. 106 through a resistor 104. The non-inverting input terminal of the sixth OP Amp. 106 and an output terminal thereof are connected together through a resistor 108. The output terminal of the fourth OP Amp. 88 is connected to a non-inverting input terminal of a seventh OP Amp. 112 through a resistor 110. The non-inverting input terminal of the seventh OP Amp. 112 and an output terminal thereof are connected to each other through a resistor 114. The inverting input terminals of the sixth and seventh OP Amps. 106 and 112 are connected to a DC power source 116 which has a predetermined output voltage through a resistor **127*a*. The inverting input terminals of the sixth and seventh OP Amps. 106 and 112 are grounded through a resistor 127*b*. The output terminal of the sixth OP Amp. 106 is connected to a throttle valve close circuit 118 and one input terminal of a first OR gate circuit 120. The output terminal of the seventh OP Amp. 112 is connected to a throttle valve open circuit 122 and the other terminal of the first OR gate circuit 120. When the throttle valve close circuit 118 receives a signal of high level, the throttle valve close circuit 118 drives the motor 56 to make the throttle valve 48 further close the unit duct 40. On the other hand, when the throttle valve open drive circuit 122 receives a signal of high level, the throttle valve open circuit 122 drives the motor 56 to make the throttle valve 48 further open the unit duct 40. When the signal of low level is supplied to the throttle valve close circuit 118 and the throttle valve open circuit 122, the motor 56 stops rotating so that the throttle valve 48 is maintained at the current position. An output terminal of the first OR gate circuit 120 is connected to an input terminal of a second bilateral switch 126 through a resistor 124. The second bilateral switch 126 is arranged in the same manner as the first bilateral switch 102**.

The first and fifth OP Amps. 78 and 92 function as voltage followers which amplify an input signal at an amplification factor of 1 and output an output signal to the next stage. The second and fourth OP Amps. 82 and 88 function as differential amplifiers which amplify a potential difference between the two input terminals through the ratio of the resistors 80 and 90, and the ratio of the resistors 96 and 98, respectively and output an output signal to the next stage. For example, in the second OP Amp. 82, when the output from the fifth OP Amp. 92 is higher than that from the first OP Amp. 78, a difference therebetween is amplified and is output. On the other hand, when the output from the fifth OP Amp. 92 is lower than that from the first OP Amp. 78, the second OP Amp. 82 outputs a signal at the zero potential. Further, in the fourth OP Amp. 88, for example, when the output from the fifth OP Amp. 92 is higher than that from the first OP Amp. 78, the fourth OP Amp. 88 outputs the signal at the zero potential. On the other hand, when the output from the fifth OP Amp. 92 is lower than that from the first OP Amp. 78, the fourth OP Amp. 88 outputs a signal whose potential difference is amplified.

The sixth OP Amp. 106 or the seventh OP Amp. 112 functions as a comparator with hysteresis. When the voltage which is output from the second OP Amp. 82 is higher than a predetermined voltage which is obtained by voltage-dividing between the voltage of the DC power source 116 and the zero potential through resistors 127*a* and 127*b*, the sixth OP Amp. 106 outputs the signal of high level. Otherwise, the sixth OP Amp. 106 outputs the signal of low level. When a voltage which is output from the fourth OP Amp. 88 is higher than the predetermined voltage through the resistors 127*a* and 127*b*, as described above, the seventh OP Amp. 112 outputs the signal of high level. Otherwise, the seventh OP Amp. 112 outputs the signal of low level.

Hereupon, as described above, the sixth and seventh OP Amps. 106 and 112 function as the comparators with hysteresis. Therefore in order to invert the level of the signal from high level to low level in the sixth and seventh OP Amps. 106 and 112, the voltage which is output from the second OP Amp. 82 or the voltage which is output from the fourth OP Amp. 88 must be lowered to establish a potential difference which is determined by a resistance ratio of the resistor 104 and the resistor 108 or a resistance ratio of the resistor 110 and the resistor 114 with reference to the predetermined voltage which is obtained by dividing the voltage of the DC power source 116 through the resistors 127*a* and 127*b*.

When the signals of low level are supplied from the sixth and seventh OP Amps. 106 and 112 to the OR gate circuit 120, the OR gate circuit 120 outputs a signal of low level. When one of the signals, which are supplied from the sixth and seventh OP Amps. 106 and 112, is of high level, the OR gate circuit 120 outputs a signal of high level. In other words, when the set air quantity signal T is equal to the actual air quantity signal P, the OR gate circuit 120 outputs the signal of low level. Otherwise, the OR gate circuit 120 outputs the signal of high level. In order to prevent an operation in which signals of high level are simultaneously output from the sixth and seventh OP Amp. 106 and 112, the ratio of the resistance of the resistor 104 to that of the resistor 108, the ratio of the resistance of the resistor 110 to that of the resistor 114 and the ratio of the resistance of the resistor 127*a* that of the resistor 127*b* are determined for this purpose.

On the other hand, another DC power source 128 is arranged in addition to the DC power source 116 as described above. This DC power source 128 has first and second output terminals. The first output terminal of the DC power source 128 is connected to an input terminal of a third bilateral switch 132 through a resistor 130, one terminal of the lead switch 66 which functions as the fully-open position detector and one terminal of the lead switch 68 which functions as the completely-closed position detector. The other terminal of the lead switch 66 is connected to a motor stopping circuit 134 and a control input terminal of the third bilateral switch 132. The other terminal of the lead switch 68 is connected to the motor stopping circuit 134. When the lead switch 66 is turned on and the throttle valve 48 is thus set in the fully-open position, the motor stopping circuit 134 operates to stop rotating the motor 56 in order to interrupt the operation for opening the throttle valve 48. Further, when the lead switch 68 is turned on, that is, the throttle valve 48 is set in the completely-closed position, the motor stopping circuit 134 stops the motor 56 in order to interrupt the operation for closing the throttle valve 48. The third bilateral switch 132 has the same arrangement as the first bilateral switch 102.

The output terminal of the third bilateral switch 132 is grounded through a resistor 136 and connected to a base of an npn transistor 138. An emitter of the npn transistor 138 is grounded, and a collector thereof is connected to an anode of a diode 142 through a resistor 140, an anode of an electrolytic capacitor 144, and an inverting input terminal of an eighth OP Amp. 146. The cathode of the electrolytic capacitor 144 is grounded. The first output terminal of the DC power source 128 is connected to the anode of the diode 142 through a resistor 148. A cathode of the diode 142 is connected to a non-inverting input terminal of the eighth OP Amp. 146 and is grounded through a resistor 150. The second output terminal of the DC power source 128 is connected to the non-inverting input terminal of the eighth OP Amp. 146 through a resistor 152. The eighth OP Amp. 146 functions as a comparator. When the non-inverting input terminal of the eighth OP Amp. 146 receives a signal whose level is higher than that which is supplied to the inverting input terminal thereof, the eighth OP Amp. 146 outputs the signal of high level. Otherwise, the eighth OP Amp. 146 outputs the signal of low level.

The output terminal of the eighth OP Amp. 146 is connected to the control input terminals of the first and second bilateral switches 102 and 126. When the lead switch 66 is turned on, the motor 56 stops rotating. At the same time, the voltage is applied to the control input terminal of the third bilateral switch 132 so that the third bilateral switch 132 is rendered conductive. As a result, a bias current flows from the DC power source 128 to the npn transistor 138 through the resistor 130 so that the npn transistor 138 is rendered conductive. Therefore, the charge which is stored on the electrolytic capacitor 144 is discharged through the resistor 140 and the npn transistor 138. As a result, a voltage which is obtained by voltage-dividing the output voltage from the second output terminal of the DC power source 128 through resistors 150 and 152 is supplied to the non-inverting input terminal of the eighth OP Amp. 146. On the other hand, since the inverting input terminal of the eighth OP Amp. 146 is connected between the electrolytic capacitor 144 which is being discharged and the resistor 148, a voltage, which is higher than a voltage input to the inverting input terminal, is applied to the non-inverting input terminal. In this manner, when the lead switch 66 is turned on, the eighth OP Amp. 146 outputs the signal of high level.

When the lead switch 66 is turned off, the voltage is not applied to the control input terminal of the third bilateral switch 132 so that the third bilateral switch 132 is rendered non-conductive. Therefore, the bias voltage is not applied to the base of the npn transistor 138, so that the npn transistor 138 is rendered non-conductive. The electrolytic capacitor 144 stops discharging and is charged by the output voltage from the first output terminal of the DC power source 128 through the resistor 148. When the electrolytic capacitor 144 is charged for a predetermined period of time, a voltage which is lower than a voltage which is applied to the inverting input terminal is applied to the non-inverting input terminal of the eighth OP Amp. 146. In this manner, when the lead switch 66 is turned off, the eighth OP Amp. 146 outputs the signal of low level. In the fully-open position of the throttle valve 48, the eighth OP Amp. 146 outputs the signal of high level. On the other hand, in the not fully-open position, the eighth OP Amp. 146 outputs the signal of low level. Therefore, the first and second bilateral switches 102 and 126, in the fully-open position of the throttle valve 48, receive the signal of high level or low level and output it as it is. However, in the not fully-open position, even if the signal of high level or low level is input to the first and second bilateral switches 102 and 126, they restore the condition in which the signal of low level is constantly output, since a resistors 164 and 166 of FIG. 4 to be described later are grounded.

The output terminals of the first and second bilateral switches 102 and 126 are, respectively, connected to anodes of first and second diodes 154 and 156. The output A and the output B are supplied from the cathodes of the first and second diodes 154 and 156. In this manner, the logical results as shown in TABLE 1 are accomplished.

Output lines for the output A and the output B from the air quantity regulating devices 14, 18, 28 are connected with a "Wired OR" structure to the common damper controller 36. In binding a plurality of output lines, the "Wired OR" structure is defined as a structure in which if at least one output line outputs the signal of high level regardless of the level of other output lines, the circuit as a whole outputs the signal of high level. However, if all of the output lines output the signals of low level, the circuit as a whole outputs the signal of low level.

The detail of the damper controller 36 will be described with reference to FIG. 4. The damper controller 36 outputs a control signal for controlling the damper device 32, in response to the level signal of high and/or low level from the outputs A and B, based on the logical results as shown in TABLE 2.

TABLE 2

| | | | | | |
|---|---|---|---|---|---|
| Input level | A | "H" | "H" | "L" | "L" |
| | B | "H" | "L" | "H" | "L" |
| Control signal | | Close | Hold | Open | Open |

Figure 4:
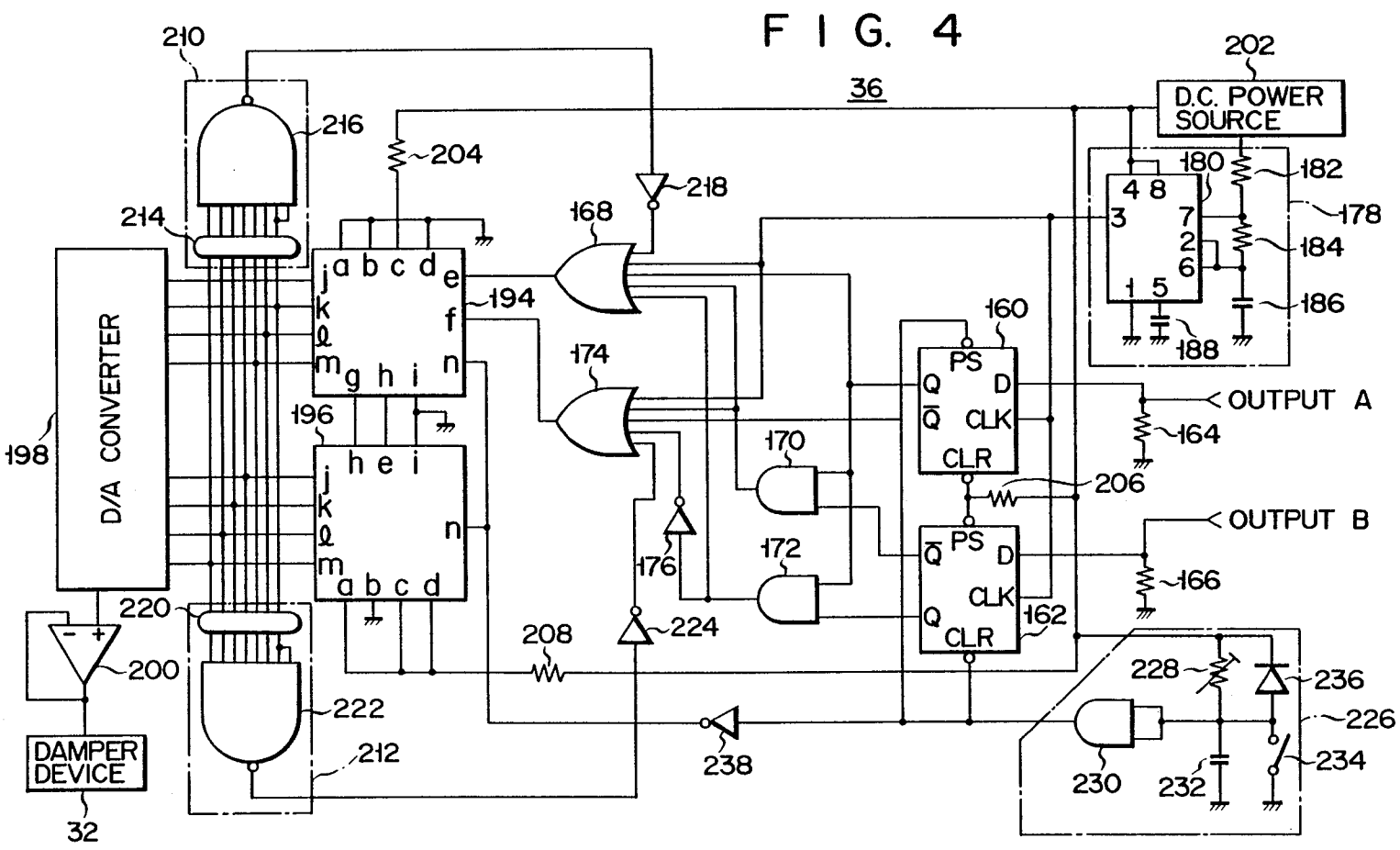
FIG. 4 is a circuit diagram showing a configuration of a damper controller.

The output A as shown in FIG. 3 is connected to an input terminal D of a first D type flip-flop 160, and the output B is connected to an input terminal D of a second D type flip-flop 162, as shown in FIG. 4. The connecting wires of the first and second D type flip-flops 160 and 162 are grounded, respectively, through resistors 164 and 166. A first output terminal Q of the first D type flip-flop 160 is connected to a first input terminal of a second OR gate circuit 168 which has five input terminals, one of the input terminals of a first AND gate circuit 170, and one of the input terminals of a second AND gate circuit 172. A second output terminal $\overline{Q}$ of the first D type flip-flop 160 is connected to a first input terminal of a third OR gate circuit 174 which has five input terminals. On the other hand, first output terminal Q of the second D type flip-flop 162 is connected to the other input terminal of the second AND gate circuit 172, and the second output terminal $\overline{Q}$ thereof is connected to the other input terminal of the first AND gate circuit 170.

The output terminal of the first AND gate circuit 170 is connected to second input terminals of the second and third OR gate circuits 168 and 174, respectively. The output terminal of the second AND gate circuit 172 is connected to the third input terminal of the second OR gate circuit 168 and the third input terminal of the third OR gate circuit 174 through an inverter 176.

The damper controller 36 includes a clock generator 178. The clock generator 178 comprises an IC 180 which may function as a timer, and two resistors 182 and 184 and two capacitors 186 and 188 which are connected to the IC 180. By arbitrarily selecting resistances of resistors 182 and 184 and capacitances of the capacitors 186 and 188, the pulse width and frequency of a clock pulse which is output from a clock output terminal 3 of the IC 180 are defined. The clock output terminal 3 of the IC 180 is connected to clock input terminals CLK of the first and second D type flip-flops 160 and 162 and the fourth input terminals of the second and third OR gate circuits 168 and 174, respectively.

The output terminals of the second and third OR gate circuits 168 and 174 as described above are, respectively, connected to a count-down input terminal e and a count-up input terminal f of a first up/down counter 194. The first up/down counter 194 is constructed by a presettable synchronous up/down 4-bit counter IC. By combining the first up/down counter 194 and a second up/down counter 196 with the same arrangement, an 8-bit up/down counter is constituted. A carry output terminal g and a borrow output terminal h of the first up/down counter 194 are, respectively, connected to a count-up input terminal b and a count-down input terminal e of the second up/down counter 196. Clear input terminals i of the first and second up/down counters 194 and 196 are connected together and are grounded. First, second, and fourth preset input terminals a, b and d of the first up/down counter 194 and a second preset input terminal b of the second up/down counter 196 are grounded.

Each up/down counter 194 or 196 counts down a digital value output in response to the number of pulse signals which are input to the count-down input terminal e, and counts up the digital value output in response to the number of pulse signals which are input to the count-up input terminal f. When a pulse signal is not input to the count-down input terminal e or the count-up input terminal f, that is, when a signal of constant level is input, the digital value at the current time is retained and output by the up/down counter 194 or 196.

First to fourth output terminals j, k, l and m of the first up/down counter 194 define first to fourth bits of 8-bit data. The outputs from the first to fourth output terminals j, k, l and m of the first up/down counter 194 are input to first to fourth input terminals of a D/A converter 198, respectively. First to fourth output terminals j, k, l and m of the second up/down counter 196 define fifth to eighth bits of the 8-bit data. The outputs from the first to fourth output terminals j, k, l and m of the second up/down counter 196 are input to fifth to eighth input terminals of the D/A converter 198. The D/A converter 198 converts the input digital value to an analog value. For example, when a binary coded signal of "00000000" of 8 bits is input to the D/A converter 198, the D/A converter 198 outputs 0 V (DC). On the other hand, when an 8-bit code, "11111111", is input to the D/A converter 198, the D/A converter 198 outputs 10 V (DC). In this manner, the D/A converter 198 outputs a DC voltage in the range of 0 to 10 V in proportion to the 8-bit digital signal. The output terminal of the D/A converter 198 is connected to a non-inverting input terminal of a ninth OP Amp. 200. An output terminal of the ninth OP Amp. 200 is connected to an inverting input terminal thereof and the input terminal of the inverter 38. Thus, the output terminal of the ninth OP Amp. 200 is defined as the output terminal of the damper controller 36.

A DC power source 202 is connected to the damper controller 36. That is, an output terminal of the DC power source 202 is connected to a third preset input terminal c of the first up/down counter 194, a reset terminal 4 and a Vcc terminal 8 of the IC 180, the clear input terminal CLR of the first D type flip-flop 160 and the preset input terminal PS of the second D type flip-flop 162 through a common resistor 206, the first, third and fourth preset input terminals a, c and d of the second up/down counter 196 through a common resistor 208. Therefore, when power is supplied, the signal of high level is supplied to the clear input terminal CLR of the first D type flip-flop 160 and the preset input terminal PS of the second D type flip-flop 162.

Lower and upper limiters 210 and 212 are connected to the damper controller 36. In the lower limiter 210, the second to fourth output terminals k, l and m of the first up/down counter 194 and the first to fourth output terminals j, k, l and m of the second up/down counter 196 are, respectively, connected to the second to eighth input terminals of a first NAND gate circuit 216, which has 8 input terminals through, a first switch circuit 214. The first switch circuit 214 is not shown in detail but it has series circuits of inverters and changeover switches. The first input terminal of the first NAND gate circuit 216 is connected to the second input terminal thereof. An output terminal of the first NAND gate circuit 216 is connected to a fifth input terminal of the second OR gate circuit 168 through an inverter 218. With this arrangement, when the count-down operation is performed to a predetermined value which is set by the first switch circuit 214, the lower limiter circuit 210 stops the count-down operation. For example, when all of the switches of the first switch circuit 214 are all turned on, the lower limiter 210 stops the count-down operation when the count value is "00000001". Further when all of the switches of the first switch circuit 214 are all turned off, the lower limiter circuit 210 does not allow the count-down operation.

On the other hand, in the upper limiter 212, the second to fourth output terminals k, l and m of the first up/down counter 194 and the first to fourth output terminals j, k, l and m of the second up/down counter 196 are, respectively, connected to the second to eighth input terminals of a second NAND gate circuit 222, which has 8 input terminals, through a second switch circuit 220. The second switch circuit 220 includes series circuits of inverters and changeover switches. In particular, each connecting wire is directly connected to one stationary contact of each changeover switch and the other stationary contact through the inverter. A movable contact of each changeover switch is connected to the corresponding input terminal of the second NAND gate circuit 222. Further, the first input terminal of the second NAND gate circuit 222 is connected to the second input terminal thereof. An output terminal of the second NAND gate circuit 222 is connected to a fifth input terminal of the third OR gate circuit 174 through an inverter 224. With the above arrangement, the count-up operation is performed to a predetermined value which is set by the second switch circuit, and the upper limiter circuit 212 interrupts the further count-up operation. For example, when all of the switches of the second switch circuit 220 are arranged so that one stationary contact is coupled to a corresponding movable contact in every switch, the second switch circuit 220 allows the count-up operation up to "11111110". On the other hand, when the switch circuit 220 is arranged so that the other stationary contact is coupled to the movable contact in every switch, the second switch circuit 220 does not allow the count-up operation once the count-down operation down to "00000001" is performed.

Further, the damper controller 36 includes a so-called "power-on reset" circuit 226. In the power-on reset circuit 226, the DC power source 202 is connected to two input terminals of the third AND gate circuit 230 through a variable resistor 228. The two input terminals of the third AND gate circuit 230 are also grounded through a capacitor 232 and an on-off switch 234. The on-off switch 234 is usually set to the off status and is arranged to perform a mannual preset operation to be described later. To both terminals of the variable resistor 228 is connected a diode 236, a cathode of which is connected to the side of the DC power source 202, and which protects the third AND gate circuit 230. The diode 236 is arranged to receive the electric charge stored in the capacitor 232 when the DC power source 202 is not supplied, so that the charge which is stored in the capacitor 232 is not directly applied to the third AND circuit 230. The output terminal of the third AND gate circuit 230 is connected to the preset input terminal PS of the first D type flip-flop 160, the clear input terminal CLR of the second D type flip-flop 162 directly, and load input terminals n of the first and second up/down counters 194 and 196 through an inverter 238.

When a power switch (not shown) of the DC power source 202 is turned on, that is, when the damper controller 36 is turned on, the power-on reset circuit 226 makes current flow through the resistor 228 so that the capacitor 232 is charged. However, the current flow is limited by the variable resistor 228, so that a predetermined period of time is required for charging the capacitor 232. For this predetermined period of time, the signal of low level is supplied to the both input terminals of the third AND gate circuit 230 and the third AND gate circuit 230 outputs the signal of low level. That is, for this period of time, the signal of low level is supplied to the preset input terminal PS of the first D type flip-flop 160 and the clear input terminal CLR of the second D type flip-flop 162. Therefore, independently of the input status of the data input terminal D, the signal of high level is output from the first output terminal Q of the first D type flip-flop 160 and the second output terminal $\overline{Q}$ of the second D type flip-flop 162 and the signal of low level is output from the second output terminal $\overline{Q}$ of the first D type flip-flop 160 and the first output terminal Q of the second D type flip-flop 162. Further, the signal of high level is supplied to the load input terminals n of the first and second up/down counters 194 and 196. In this manner, the first and second up/down counters 194 and 196 output signals in a predetermined preset condition for the predetermined period of time in which the capacitor 232 is charged after power is supplied, and these output signals are input to the D/A converter 198. Since the damper controller 36 includes the power-on reset circuit 226, the damper controller 36 does not perform irregularly, which is a characteristic of digital circuits, when power is supplied, so that a stable operating condition of the damper controller 36 is accomplished.

When the charging of the capacitor 232 is completed, the signal of high level is supplied to the two input terminals of the third AND gate circuit 230. Therefore, the third AND gate circuit 230 outputs the signal of high level. The signal of high level is supplied to the preset input terminals PS and the clear input terminals CLR of the first and second D type flip-flops 160 and 162. In response to the clock pulses input to the clock input terminals CLK of the first and second D type flip-flops 160 and 162, the first and second D type flip-flops 160 and 162 generate a signal, which is input to the input terminals D, from the output terminals Q and a signal, which is input to the input terminals D and which is inverted, from the output terminals $\overline{Q}$. In response to the signal of high level which is output from the third AND gate circuit 230, the first and second up/down counters 194 and 196 are released from a predetermined mode of operation and output digital signals in accordance with the input statuses of the count-up input terminals f and count-down input terminals e.

The general mode of operation of the damper controller 36 will be described with reference to the timing charts as shown in FIGS. 5A to 5K.

Figures 5A, 5B, 5C, 5D, 5E, 5F, 5G, 5H, 5I, 5J, 5K:
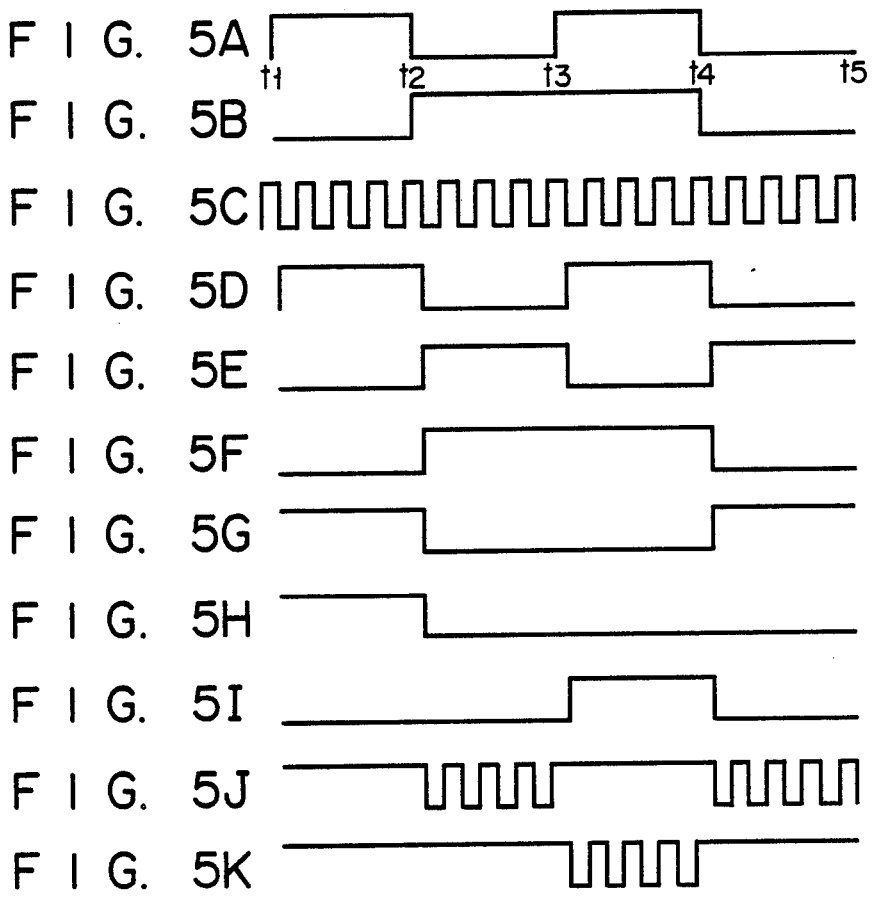
FIGS. 5A to 5K are timing charts for illustrating the operation of the damper controller.

Referring to FIGS. 5A and 5B, from time t1 to time t2, assume that the signal of high level (output A of high level) is supplied to the input terminal D of the first D type flip-flop 160 and the signal of low level (output B of low level) is supplied to the input terminal D of the second D type flip-flop 162. Clock pulses are supplied from the clock generator 178 to the clock input terminals CLK of the first and second D type flip-flops 160 and 162, as shown in FIG. 5C. Therefore, the signal of high level is output from the first output terminal Q of the first D type flip-flop 160, as shown in FIG. 5D, and the signal of low level is output from the second output terminal $\overline{Q}$ of the first D type flip-flop 160, as shown in FIG. 5E. The signal of low level is output from the first output terminal Q of the second flip-flop 162 as shown in FIG. 5F, and the signal of high level is output from the second output terminal $\overline{Q}$ thereof, as shown in FIG. 5G. Therefore, the signal of high level is output from the first AND gate circuit 170 as shown in FIG. 5H, and the signal of low level is output from the second AND gate circuit 172 as shown in FIG. 5I. Since the signal of high level is supplied to at least one input terminal of the second and third OR gate circuits 168 and 174, the second and third OR gate circuits 168 and 174 constantly output the signal of high level, as shown in FIGS. 5J and 5K even if the clock pulses are input. Thus, the first and second up/down counter 194 and 196 maintain the output status. In this manner, when the output A is of high level and the output B is of low level, the damper controller 36 does not change the content of the current control signal.

As shown in FIGS. 5A and 5B, from time t2 to time t3, assume that the signal of low level (output A of low level) is supplied to the input terminal D of the first D type flip-flop 160 and the signal of high level (output B of high level) is supplied to the input terminal D of the second D type flip-flop 162. The signal of low level is output from the first output terminal Q of the first D type flip-flop 160 as shown in FIG. 5D, and the signal of high level is output from the second output terminal $\overline{Q}$ of the first D type flip-flop 160 as shown in FIG. 5E. On the other hand, the signal of high level is output from the first output terminal Q of the second D type flip-flop 162 as shown in FIG. 5F and the signal of low level is output from the second output terminal $\overline{Q}$ of the second D type flip-flop 162 as shown in FIG. 5G. Therefore, the signal of low level is output from the first AND gate circuit 170 as shown in FIG. 5H, and the signal of low level is output from the second AND gate circuit 172 as shown in FIG. 5I. Since the signal of high level other than the clock pulse is not input to the input terminals of the second OR gate circuit 168, the second OR gate 168 outputs the clock pulse as shown in FIG. 5J. On the other hand, the signal of high level is input to at least one input terminal of the third OR gate circuit 174, so that the third OR gate circuit 174 constantly outputs the signal of high level as shown in FIG. 5K even if the clock pulse is input to the third OR gate circuit 174. Thus, the first and second up/down counters 194 and 196 are maintained in the count-down condition. In this manner, when the output A is of low level and the output B is of high level, the damper controller 36 operates to change the content of the current control signal in order to perform the opening operation.

As shown in FIGS. 5A and 5B, from time t3 to t4, assume that the signal of high level (output A of high level) is supplied to the input terminal D of the first D type flip-flop 160 and the signal of high level (output B of high level) is supplied to the input terminal D of the second D type flip-flop 162. The signal of high level is output from the first output terminal Q of the first D type flip-flop 160 as shown in FIG. 5D, and the signal of low level is output from the second output terminal $\overline{Q}$ of the first D type flip-flop 160 as shown in FIG. 5E. On the other hand, the signal of high level is output from the first output terminal Q of the second D type flip-flop 162 as shown in FIG. 5F, and the signal of low level is output from the second output terminal $\overline{Q}$ of the second D type flip-flop 162 as shown in FIG. 5G. Therefore, the signal of low level is output from the first AND gate circuit 170 as shown in FIG. 5H and the signal of high level is output from the second AND gate circuit 172 as shown in FIG. 5I. Since the signal of high level is supplied to at least one input terminal of the second OR gate circuit 168, the second OR gate circuit 168 constantly outputs the signal of high level as shown in FIG. 5J even if the clock pulse is input. On the other hand, the signal of high level except for the clock pulse is not supplied to the input terminals of the third OR gate circuit 174, so that the third OR gate circuit 174 outputs the clock pulse as shown in FIG. 5K. The first and second up/down counters 194 and 196 start the count-up operation. In this manner, when the output A is of high level and the output B is of high level, the damper controller 36 operates to change the content of the current control signal to perform the closing operation.

Further, as shown in FIGS. 5A and 5B, from time t4 to time t5, assume that the signal of low level (output A of low level) is supplied to the input terminal D of the first flip-flop 160 and the signal of low level (output B of low level) is supplied to the input terminal D of the first D type flip-flop 162. The signal of low level is output from the first output terminal Q of the first D type flip-flop 160 as shown in FIG. 5D and the signal of high level is output from the second output terminal $\overline{Q}$ of the first D type flip-flop 160 as shown in FIG. 5E. On the other hand, the signal of low level is output from the first output terminal Q of the second D type flip-flop 162 as shown in FIG. 5F and the signal of high level is output from the second output terminal $\overline{Q}$ of the second D type flip-flop 162 as shown in FIG. 5G. Therefore, the signal of low level is output from the first AND gate circuit 170 as shown in FIG. 5H and the signal of low level is output from the second AND gate circuit 172 as shown in FIG. 5I. Since the signal of high level except for the clock pulse is not input to the input terminals of the second OR gate circuit 168, the second OR gate circuit 168 outputs the clock pulse as shown in FIG. 5J. On the other hand, since the signal of high level is supplied to at least one input terminal of the third OR gate circuit 174, the third OR gate circuit 174 constantly outputs the signal of high level as shown in FIG. 5K even if the clock pulse is input to the third OR gate circuit 174. The first and second up/down counter 194 and 196 start the count-down operation. The damper controller 36 operates to change the content of the current control signal to perform the opening operation.

In this manner, logical results as shown in TABLE 2 are accomplished.

When the output A is of low level and the output B is of low level, the pieces of data which are indicated by the actual air quantity signal and the pieces of data which are indicated by the set air quantity signal are equal. That is, P=T. Therefore, basically, "hold" mode must be established. However, if the condition is held as it is, this is interpreted as the condition in which the output A is of low level and the output B is of low level according to TABLE 1. In particular, the damper device 32 operates to decrease the quantity of air even if the throttle valve 48 is not fully opened, so the throttle valve 48 cannot fully open. Therefore, in the above case, the content of the control signal defines the "opening" mode. However, when the opening mode continues even if the throttle valve 48 is fully open, the air quantity gradually decreases, so that the output A changes from low level to high level. Then the output A of high level and the output B of low level are accomplished, resulting in the "hold" mode.

Now the operation of the air conditioning system having the air quantity regulating devices for the incoming outside air and exhaust will be described.

First, let it be supposed that the operations for the outside air intake and exhaust are stopped.

In this case, the throttle valves 48 of all the air quantity regulating devices 14, 18 and 28 are completely closed, so that the output of the damper controller 36 is lowered. Thus, as the damper unit 32 is moved in an opening direction, the circulating duct **12*i*** is fully opened.

In this state, the discharged air is all circulated, and pressure loss between the discharging blower 26 and the air conditioner 10 is minimal, since the damper unit 32 is fully open.

Subsequently, let us suppose that the incoming outside air quantity and exhaust air quantity are set by the external air quantity setter 34.

In this case, the air quantity regulating devices 14, 18 and 28 continue the opening operation until the air quantity set by the external air quantity setter 34 becomes equal to the actual air quantity detected by the air quantity detector 42.

If the set air quantity becomes equal to the detected air quantity in a state such that the throttle valves 48 of the air quantity regulating devices 14, 18 and 28 are not fully open (or in the position between the fully-open position and the completely-closed position), the output of the damper controller 36 is kept minimal. Accordingly, the damper unit 32 remains fully open.

If the throttle valve 48 of the exhaust air quantity regulating device 28 is fully open, and if the set air quantity is smaller than the detected air quantity, then the damper controller 36 increases its output to close the damper unit 32.

As a result, the resistance between the discharging blower 26 and the air conditioner 10 increases, so that the pressure inside the duct **12*g* connected to the exhaust air quantity regulating device 28 rises. Thus, the quantity of air passing through the air quantity regulating device 28** is increased.

When the air quantity detected by the air quantity detector 42 becomes equal to the set value, the output of the damper controller 36 ceases to increase, and the damper **32*a* of the damper unit 32 keeps its position so that the output condition of the damper controller 36** is maintained.

At this time, the quantity of circulated air for the air conditioner 10 is reduced, so that the pressure inside the ducts **12*a* and 12*d* communicating respectively with the incoming outside air quantity regulating devices 14 and 18** is decreased. Thus, the quantity of incoming outside air is inevitably increased.

However, in the one embodiment, the air quantity detectors 42 of the first to third air quantity regulating devices 14, 18 and 28 make the corresponding propellers 44 rotate in accordance with the increase of the quantity of air which passes through the unit duct 40. Therefore, the level of the signal whose content is defined as P which indicates the actual quantity of air stream which passes through the unit duct 40 increases. In particular, the actual quantity of air which passes through the unit duct 40 and which is indicated by P is larger than the air quantity which is set by the setter and which is indicated by T. The signal of high level is supplied to the throttle valve close circuit 118 through the second and sixth OP Amp. 82 and 106. The signal of low level is supplied to the throttle valve open circuit 122. When the throttle valve 48 is not fully closed, that is, when the lead switch 68 which functions as the completely-closed position detector is not turned on and the motor stopping circuit 134 is not operated, the throttle valve close circuit 118 makes the motor 56 rotate so that the throttle valve 48 accordingly rotates in the closing direction. The opening area of the respective unit ducts 40 of the first and second air quantity regulating devices 14, 18 is reduced, so that the air channel is throttled. The closing operation of the throttle valve 48 continues until the actual quantity of air which passes through the unit duct 40 and which is indicated by P becomes equal to the air quantity which is set by the setter 34 and which is indicated by T, that is, until the signal of high level ceases to be supplied to the throttle valve close circuit 118 through the second and sixth OP Amps. 82 and 106. Therefore, the first to third air quantity regulating devices 14, 18, 28 adjust the quantity of air which passes the respective unit ducts 40 to the air quantity which is set by the setter 34.

Then, in this embodiment, each (air quantity detector 42) of the first to third air quantity regulating devices 14, 18 and 28 makes the corresponding propellers 44 rotate in accordance with a decrease in the quantity of air which passes through the corresponding unit duct 40. Therefore, the actual quantity of air stream which passes through the unit duct 40 decreases. In particular, the actual quantity P of air which passes through the unit duct 40 becomes smaller than the air quantity which is set by the setter 34 and which is represeted by T. The signal of high level is thus supplied to the throttle valve open circuit 122 through the fourth and seventh OP Amps. 88 and 112. On the other hand, the signal of low level is supplied to the throttle valve close circuit 118. When the throttle valve 48 is not fully open, that is, when the lead switch 66 which functions as the fully-open position detector 66 is not turned on and the motor stopping circuit 134 does not operate, the throttle valve open circuit 122 makes the motor 56 rotate so that the throttle valve 48 rotates in the opening direction. The opening area of each unit duct 40 of the first to third air quantity regulating devices 14, 18 and 28 increases. The opening operation of the throttle valve 48 continues until the actual quantity P of air which passes through the unit duct 40 becomes equal to the air quantity which is set by the setter 34 and which is indicated by T. Therefore, the actual quantity of air which passes through each unit duct 40 of the first to third air quantity regulating devices 14, 18, 28 is maintained equal to the predetermined air quantity which is set by the setter 34. In this manner, the effect is accomplished in which a constant quantity of air passes through each unit duct 40 of the air quantity regulating devices 14, 18 and 28.

Figure 6:
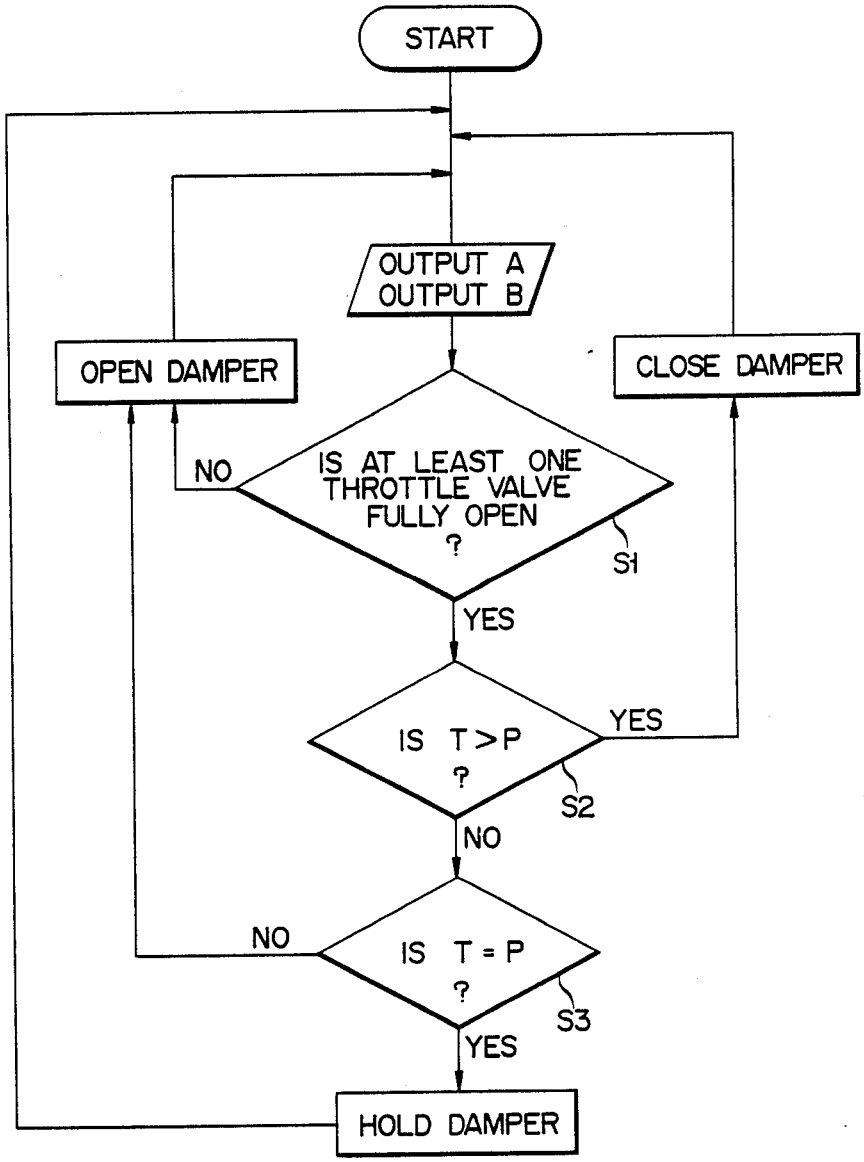
FIG. 6 is a flow chart for illustrating the control sequence of the damper controller.

Referring now to the flow chart of FIG. 6, the control process for the damper controller 36 will be described.

The damper unit 32 is controlled so that the throttle valve 48 of at least one air quantity regulating device is fully open.

Thus, if any of the throttle valves 48 of the air quantity regulating devices is fully open, then it can be said that the passage air quantity is proper or that the energy or pressure required for the outside air intake and exhaust is insufficient. On the other hand, if none of the throttle valves 48 is fully open, then the pressure must be too great.

In step S1, the question whether the throttle valve 48 of at least one air quantity regulating device is fully open is decided. If the decision is "NO", that is, if signals of low level are delivered from both outputs A and B, the damper 32*a* of the damper unit 32 is moved in the opening direction to reduce the pressure loss between the discharging blower 26 and the charging blower 10*a*. Accordingly, the energy or pressure for the outside air intake and exhaust is reduced through the air quantity regulating devices, so that the quantity of air passing through the regulating devices is decreased. Thereupon, the air quantity regulating devices open their respective throttle valves 48 in order to maintain the predetermined air quantity.

The reduction of the incoming outside air quantity and exhaust air quantity by opening the damper unit 32 is continued until it is detected that the throttle valve 48 of at least one air quantity regulating device is fully opened.

Thus, if the decision in step S1 is "YES", step S2 is executed. In step S2, the question whether the set air quantity T is greater than the actual air quantity P is decided. If the decision here is "YES", that is, if signals of high level are delivered from the outputs A and B, the damper 32*a* of the damper unit 32 is moved in the closing direction. This is done because the decision "YES" in step S2 indicates a shortage of the pressure used for the outside air intake and exhaust.

If the decision in step S2 is "NO", step S3 is executed. In step S3, the question whether the set air quantity T is equal to the actual air quantity P is decided. If the decision here is "NO", the damper unit 26 is opened. This is done because the decision "NO" in step S3 indicates the existence of excessive pressure for the outside air intake and exhaust.

If the decision in step S3 is "YES", the damper unit 32 maintains its opening position. This situation is obtained because the equality between the set air quantity T and actual air quantity P attained through the aforesaid processes indicates that the incoming outside air quantity and exhaust air quantity obtained are optimum in the situation that the resistance between the discharging blower 26 and the charging blower 10*a* is minimal.

In the one embodiment of the present invention, as described above, the air quantity regulating devices 14, 18 and 28 automatically perform constant air quantity control by the use of their respective air quantity detectors 42 and throttle valves 48. Thus, the incoming outside air quantity and exhaust air quantity can be set accurately.

The air quantities detected by the air quantity regulating devices 14, 18 and 20 are actual quantities that are subject to the influence of the direction and speed of the wind, the pressure loss between the ducts, branch ducts and filter, etc. Therefore, the air quantity regulating devices 14, 18 and 28 themselves are not affected by these factors.

Figure 7:
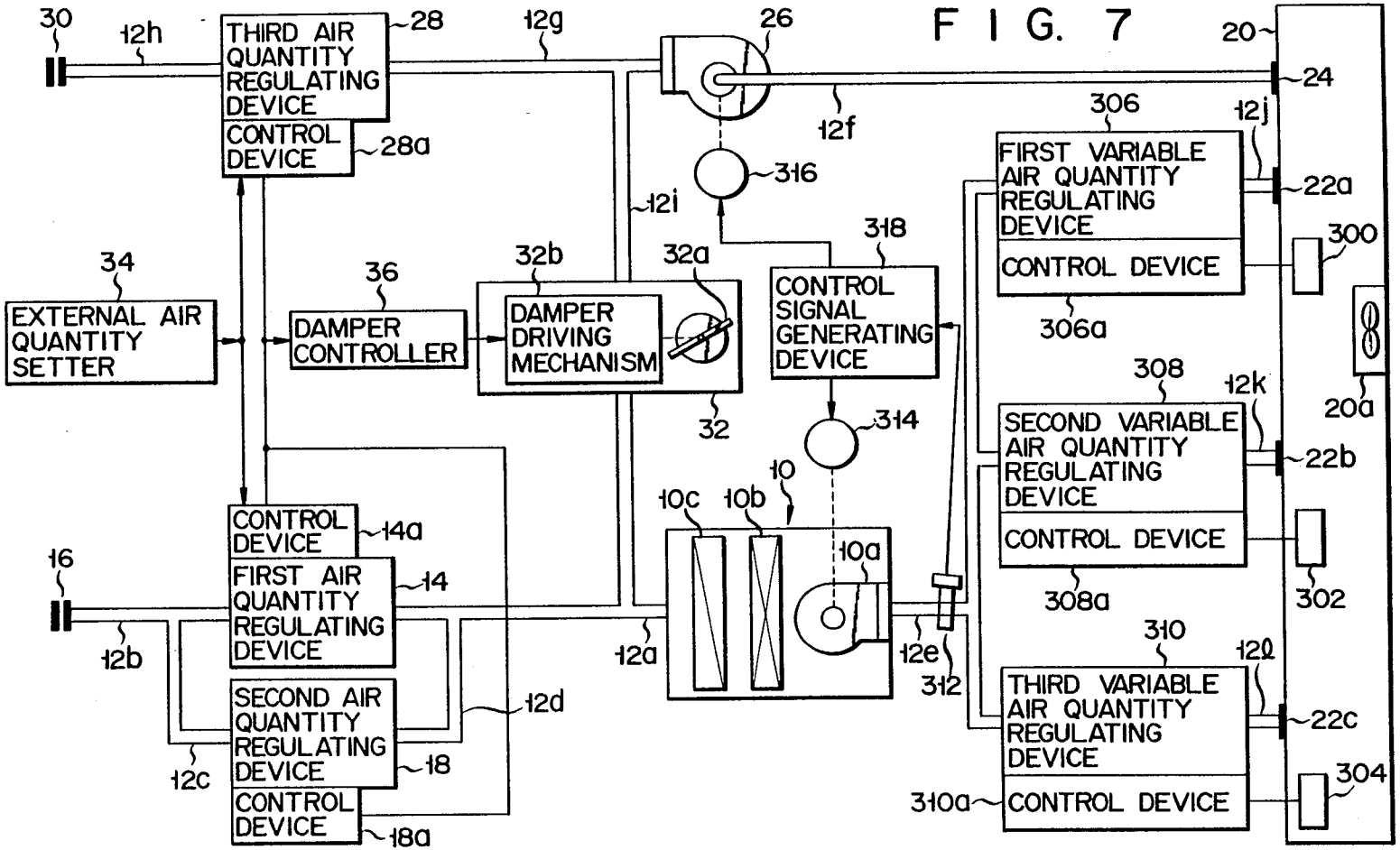
FIG. 7 is a diagram showing an arrangement of a modification of the air conditioning system.

In an air conditioning system of a variable air quantity type as a modification, as shown in FIG. 7, first to third variable air quantity regulating devices 306, 308 and 310 communicating with their corresponding air conditioning zones 20 control the charging air quantity by means of their corresponding control devices 306*a*, 308*a* and 310*a* in accordance with instructions from room thermostats 300, 302 and 304 in the individual air conditioning zones 20. Thus, fresh air is supplied from the first to third variable air quantity regulating devices 306, 308 and 310 through ducts 12*i*, 12*k* and 12*l* connected thereto and blow-off ports 22*a*, 22*b* and 22*c* attached to the individual air conditioning zones 20.

In this case, if the charging blower 10*a* is kept in constant operating condition, the pressure inside the charging duct 12*e* may increase or decrease, depending on the fluctuations of load in the air conditioning zones 20. In general, therefore, the operating condition of the blower 10*a* is controlled. This modification is additionally provided with a pressure detector 312 for detecting the pressure inside the charging duct 12*e*, a variable-speed motor 314 for driving the charging blower 10*a*, a variable-speed motor 316 for driving the discharging blower 26, and a control signal generating device 318 for controlling the rotational frequency of the variable-speed motors 314 and 316 in accordance with a signal from the pressure detector 312. The operating conditions of the blowers are controlled according to the changes of charging air quantity of the variable air quantity regulating devices 306, 308 and 310.

In the air conditioning system of this variable air quantity type, the energy for the outside air intake and exhaust varies with the changes of the operating conditions of the blowers which depend on the fluctuations of load in the air conditioning zone 20. Thus, it is impossible to secure the predetermined incoming outside air quantity and exhaust air quantity. By controlling the damper unit 32 in the circulating duct 12*i* on the basis of the quantity of air passing through the air quantity regulating devices 14, 18 and 28 for the outside air intake and exhaust, however, the blast energy from the discharging and charging blowers 26 and 10*a* can properly be allotted for the outside air intake, exhaust and circulation, without being affected by the changes of the operating conditions of the blowers 10*a* and 26.

Thus, the air conditioning system of the invention controls the quantities of air passing through the air quantity regulating devices 14, 18 and 28 that are affected by the variable conditions related to the outside air intake and exhaust. Therefore, the system can perform stable air quantity control without being affected by the changes of those conditions itselt.

It is to be understood that the present invention is not limited to the one embodiment described above, and that various changes and modifications may be effected therein by one skilled in the art without departing from the scope or spirit of the invention.

Figure 8:
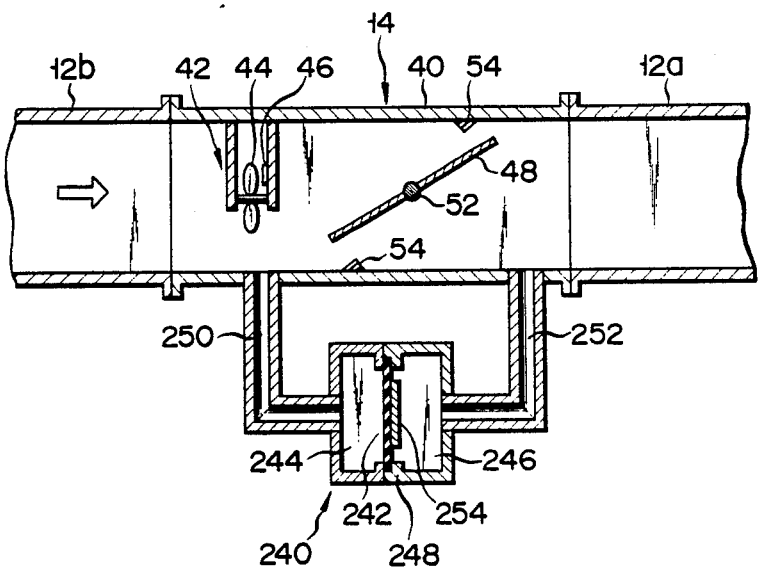
FIG. 8 is a sectional side view schematically showing an air quantity regulating device used in an air conditioning system according to another embodiment of the invention.

Referring now to FIG. 8, another embodiment of the air conditioning system of the present invention will be described. In the description of this second embodiment to follow, like reference numerals refer to the same portions as included in the first embodiment.

In the one embodiment, the fully-open position detector of the throttle valve 48 comprises the lead switch 66 in order to detect directly the position of the throttle valve 48. The limit switches may be also used for this purpose in the first embodiment. However, the fully-open position detector is not limited to these switches. An arrangement as shown in FIG. 8 may be utilized. In particular, a fully-open position detector 240 comprises a main body 248 which is divided into first and second pressure chambers 244 and 246 by a diaphragm 242. The first pressure chamber 244 is disposed on the upstream side of the unit duct 40 and communicates with the unit duct 40 through a first communicating path 250. On the other hand, the second pressure chamber 246 is disposed on the downstream side of the unit duct 40 and communicates with the unit duct 40 through a second communicating path 252. A distortion guage 254 is attached to the diaphragm 242. The distortion guage 254 detects the distortion of the diaphragm 242 which is distorted by a pressure difference between the area before the throttle valve 48 and the area after the throttle valve 48 within the unit duct 40. Further, the distortion guage 254 outputs an electric signal in correspondence with the degree of the distortion of the diaphragm 242. When throttle valve 48 is set in the fully-open position, the pressure difference between the first and second pressure chambers 244 and 246 is minimized. This condition is detected as the fully-open condition by the distortion gauge 254.

The diaphragm 242 as shown in FIG. 8 may be replaced by a piston.

What is claimed is:

1. An air conditioning system which performs outside air intake through an outside air intake port and exhaust through an exhaust port by the use of a charging blower and a discharging blower connected to the outside air intake port and the exhaust port, respectively, by means of ducts, thereby controlling the incoming outside air quantity and exhaust air quantity, comprising:

a first air quantity regulating device for controlling the exhaust air quantity, including a first air quantity detector disposed in a first duct connecting the discharging blower and the exhaust port, for detecting the quantity of air passing through the first duct, a first throttle valve movable between a first position where the first duct is fully open and a second position where the first duct is completely closed, a first drive mechanism for driving the first throttle valve, and a first control mechanism capable of setting the maximum allowable passage air quantity and adapted to control the first drive mechanism so that the set passage air quantity becomes equal to the air quantity detected by the first air quantity detector;

a second air quantity regulating device for controlling the incoming outside air quantity, including a second air quantity detector disposed in a second duct connecting the charging blower and the outside air intake port, for detecting the quantity of air passing through the second duct, a second throttle valve movable between a first position where the second duct is fully open and a second position where the second duct is completely closed, a second drive mechanism for driving the second throttle valve, and a second control mechanism capable of setting the maximum allowable passage air quantity and adapted to control the second drive mechanism so that the set passage air quantity becomes equal to the air quantity detected by the second air quantity detector; and a damper unit including a damper disposed in a third duct connecting the respective middle portions of fourth and fifth ducts and movable between a third position where the third duct is fully open and a fourth position where the third duct is completely closed, said fourth duct connecting the discharging blower and the first air quantity regulating device, and said fifth duct connecting the charging blower and the second air quantity regulating device, a third drive mechanism for driving the damper, and a third control mechanism adapted to move and open the damper until the throttle valve of at least one of the air quantity regulating devices reaches the first position when neither of the throttle valves of the two air quantity regulating devices is in the first position, to move and close the damper so as to increase the passage air quantity when the air quantity detected by the air quantity detector of the air quantity regulating device whose throttle valve is in the first position is smaller than the set air quantity, and to maintain the position of the damper when said detected air quantity is equal to the set air quantity.

2. The system according to claim 1, wherein each said air quantity regulating device includes a first comparator adapted to deliver an output signal of a first level when the set air quantity is smaller than the detected air quantity, and to deliver an output signal of a second level when the set air quantity is larger than the detected air quantity, a second comparator adapted to deliver an output signal of the first level when the set air quantity is equal to the detected air quantity, and to deliver an output signal of the second level when the set air quantity is not equal to the detected air quantity, and first and second output means connected to the first and second comparators, respectively, and adapted to deliver a signal applied thereto as it is when the throttle valve is in the first position, and to deliver a signal of the first level whenever the throttle valve is not in the first position; and said third control mechanism includes a logic circuit receiving the output signals from the first and second output means and delivering operand signals, and a converter circuit connected to the logic circuit and delivering an instruction signal for designating the position of the damper of the damper unit in accordance with the operand signals, said logic circuit is adapted to deliver an operand signal to move the damper of the damper unit in an opening direction when supplied with the first-level signal from the first output means, to deliver an operand signal to maintain the damper position in the damper unit when supplied with the second-level signal from the first output means and the first-level signal from the second output means, and to deliver an operand signal to move the damper of the damper unit in a closing direction when supplied with the second-level signals from the first and second output means.

3. The system according to claim 2, wherein said converter circuit includes an up/down counter delivering a digital value in accordance with the operand signal from the logic circuit, and a D/A converter connected to the up/down counter and delivering an analog value corresponding to the digital value, and said damper unit regulates the opening of the damper in accordance with the analog value supplied from the D/A converter.

4. The system according to claim 3, wherein said air quantity regulating device includes a power-on reset circuit connected to the up/down counter and adapted to cause the up/down counter deliver a predetermined digital value for a tiven time after power is turned on.

5. The system according to claim 4, wherein said air quantity regulating device includes a count-down limiter circuit and a count-up limiter circuit connected to the up/down counter, the count-down limiter circuit determining the lower limit of the digital value delivered from the up/down counter, and the count-up limiter circuit determining the upper limit of the digital value delivered from the up/down counter.

6. The system according to claim 1, wherein said first and second control mechanisms can externally set an air quantity not greater than the maximum allowable passage quantity.

7. The system according to claim 1, wherein said first and second control mechanisms can internally set an air quantity not greater than the maximum allowable passage air quantity.

* * * * *